US006293014B1

(12) United States Patent
Kitazawa et al.

(10) Patent No.: US 6,293,014 B1
(45) **Date of Patent: *Sep. 25, 2001**

(54) METHOD FOR MAKING A FIXATION ROLLER

(75) Inventors: Kesaaki Kitazawa, Mishima; Shigetoshi Takasu, Tokyo; Takehiro Chinen, Aichi, all of (JP)

(73) Assignees: Nitto Kogyo Co., Ltd.; Sumitomo Light Metal Industries, Ltd., both of Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 587 days.

(21) Appl. No.: 08/670,805

(22) Filed: Jun. 25, 1996

(30) Foreign Application Priority Data

Jun. 27, 1995 (JP) ..... 7-184665

(51) Int. Cl.[7] ..... B23P 15/00
(52) U.S. Cl. ..... 29/895.2
(58) Field of Search ..... 165/89, 104.26; 219/216, 469, 470; 492/46; 29/895.2

(56) References Cited

U.S. PATENT DOCUMENTS 3,537,514 * 11/1970 Levedahl ..... 165/104.26
4,064,933 * 12/1977 Schuman ..... 165/89
4,116,266 * 9/1978 Sawata et al. ..... 165/104.26 X
4,440,215 * 4/1984 Grover et al. ..... 165/104.26 X
5,300,996 * 4/1994 Yokoyama et al. ..... 219/216 X

FOREIGN PATENT DOCUMENTS 58-22891 A 2/1983 (JP) .
4-335691 A 11/1992 (JP) .
08248797 A 9/1996 (JP) .

* cited by examiner

*Primary Examiner*—I Cuda Rosenbaum
(74) *Attorney, Agent, or Firm*—Flynn, Thiel, Boutell & Tanis, P.C.

(57) ABSTRACT

The present invention relates to an improvement in a fixation roll consisting of several heat pipes embedded in the thick wall of the hollow cylindrical core in the axial direction, and features the fact that each of the heat pipes consisting of a copper tube and encapsulated water as the operating fluid is heated to allow the water as the operating fluid to evaporate to generate pressure and cause the heat pipe to expand and tightly fit onto the inner wall surface of the cylindrical bore in the core so as to form an integral and monolithic structure comprising the heat pipe and the core. Since the heat pipe is firmly fitted to the inner wall surface of the cylindrical bore in the core, a high quality fixation roll exhibiting a uniform surface temperature distribution is provided. Since the installation of the heat pipe is effected by means of the tube expansion, no strict dimensional control of the diameters of the bore for inserting the heat pipe as well as the heat pipe is required.

3 Claims, 1 Drawing Sheet

METHOD FOR MAKING A FIXATION ROLLER

FIELD OF THE INVENTION

This invention relates to the improvement of and the manufacturing method for a fixation roll for an electrophotographic apparatus, specifically having two or more heat pipes embedded in the thick wall of the core of the fixation roll.

BACKGROUND OF THE INVENTION

In a fixation system with a heating roll which is commonly employed for electrophotographic apparatus, a fixation roll having a surface parting layer consisting of a fluorocarbon resin is employed and the copying paper carrying the image formed with an unfixed toner powder is fed between the surfaces of the fixation roll and press rolls to fix the toner on the copying paper by fusing it using heat and pressure.

For the heating roll fixation method, the heat pipe-type fixation roll with multiple heat pipes embedded in the thick wall of the core in the direction parallel to its axis has been developed, to prevent any uneven temperature distribution on the surface of the fixation roll immediately after energizing the halogen heaters and during service as a result of heat loss due to the passage of copying paper.

The inventor and others have previously proposed a type of fixation roll exhibiting a more uniform surface temperature distribution than that of conventional fixation rolls by improving the structure of the heat pipes embedded in the heat pipe type fixation roll. (Unexamined Japanese Patent Publication No. 4-139481.) The heat pipe employed in the fixation roll consists of a metal tube that encapsulates an operating fluid and a wick of elastic metal wires bent to form a hairpin shape in such a manner that the mutual distance gradually increases from the middle of the tube toward the free end, and the wick in the special shape causes the operating fluid to travel during reflux in the axial direction with the rotation of the fixation roll to substantially improve the surface temperature distribution of the fixation roll.

In the process of subsequent tests and reviews with the aim of further improving the temperature rise speed of the heat pipe type roll and the surface temperature distribution during the service of the fixation roll, the inventor and others discovered that the degree of fitting tightness of the heat pipe to the wall of the core when embedding the heat pipe in the fixation roll has an influence on the improvement of the characteristics.

For embedding the heat pipe in the fixation roll, such methods as first tightly fitting the heat pipe with the inner wall surface of the bore in the core and then sealing each end of the cylindrical bore with aluminum or an equivalent component to secure dimensional precision for the tight fitting of the heat pipe with the matching bore provided in the axial direction of the core as well as provisionally heating the core and shrink fitting the heat pipe are exercised. These methods require stringent control of the dimensional precision of the diameters of the bore and the heat pipe to obtain a firm fitting.

As a result of studies, the inventors and others have discovered that by encapsulated water as the operating fluid in the heat pipe and subsequently heating the water to allow it to evaporate after inserting the heat pipe into the core so as to cause the heat pipe to undergo plastic deformation and expand due to the pressure and to tightly fit against the inner wall of the bore in the core, resulting in an integral and monolithic structure, the heat pipe fits firmly onto the inner wall of the bore and thus the performance of the fixation roll can be further improved as compared with the abovementioned method without the need for stringent control of the dimensional precision of the diameters of the bore and the heat pipe.

SUMMARY OF THE INVENTION

The present invention is based on the abovementioned discovery and its primary object is to provide the electrophotographic fixation roll with a further improved surface temperature distribution by enhancing the fitting tightness of the heat pipe with the inner wall of the bore in the core by means of a tube expansion method.

Another object of the invention is to provide a manufacturing method for the electrophotographic fixation roll enabling the embedding of the heat pipe without the need for such stringent control of dimensional precision of the diameters of the heat pipe and the bore for inserting the heat pipe and also the embedding operation in a short period of time.

To achieve the abovementioned object, the fixation roll for an electrophotographic apparatus under the present invention is characterized by the fact that, in the fixation roll consisting of several tubes embedded in the thick wall of the hollow cylindrical core in the axial direction, each tube constituting the heat pipe consists of a copper tube and that the heat pipe, which is tightly fitted in the thick wall of the fixation roll by allowing the tube to expand and undergo plastic deformation, has a Vickers hardness in the range of 40 to 90 (under a testing load of 0.5 kgf).

The manufacturing method for the fixation roll for an electrophotographic apparatus under the present invention consisting of multiple heat pipes embedded in the thick wall of the hollow cylindrical core in the axial direction is primarily characterized by the fact that each heat pipe consisting of a copper tube containing water as the operating fluid is inserted into one of several bores provided in parallel to the axis in the thick wall of the core and the operating fluid is allowed to evaporate by heating and the heat pipe is allowed to expand by plastic deformation by means of the resultant pressure so as to make each of the heat pipes tightly fit to the inner wall of the matching bore to form an integral and monolithic structure.

Further, a) the operating fluid encapsulated in the heat pipes is water and the amount of the said operating fluid occupies 7 to 40% of the inner volume of each heat pipe and b) the wall thickness of the heat pipes consisting of copper tube before the expansion is 0.2 to 0.6 mm are respectively the secondary and tertiary characteristics of the invention.

DETAILED DESCRIPTION OF THE PREFERRED EMBODIMENT

Figure 3:
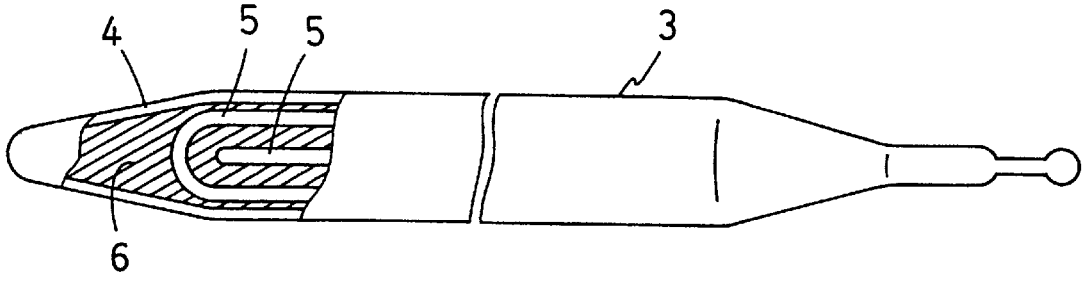
FIG. 3 is a side elevational view of the partially cut away heat pipe of an embodiment of the present invention.

The present invention assumes as a prerequisite that the fixation roll 1 consisting of a hollow cylindrical core 2, of which a thick wall is provided with several bores formed in parallel to the axis X-Y of core 2, for example the cylindrical bore 7 is bored in which heat pipe 3 is embedded and that, as shown in FIG. 3, tube 4 constituting heat pipe 3 consists of a copper tube and the tube 4 is expanded and undergoes plastic deformation and tightly fits the inner wall 8 of cylindrical bore 7 of core 2, and resultantly, core 2 and heat pipe 3 are tightly fitted together to constitute an integral structure.

The characteristic in terms of manufacture of the fixation roll under the present invention comprises the heat pipe consisting of a copper tube and containing water as the operating fluid is for example inserted into a cylindrical bore and allowed to readily expand by softening the copper tube by heating and that the water as the operating fluid is allowed to evaporate to pressurize and expand the heat pipe to allow it to be tightly fitted to the inner wall of the cylindrical bore.

As the copper tube that constitutes the heat pipe, refined 1/16H phosphorous deoxydized copper C1220T conforming to JIS H 3300 (Vickers hardness 85 after heat expansion), the refined material O of phosphorous deoxydized copper C1220T conforming to JIS H 3300 (Vickers hardness 85 after heat expansion), refined 1/16H oxygen-free copper C1020T conforming to JIS H 3300 (Vickers hardness 85 after heat expansion), and the material O of oxygen-free copper C1020T conforming to JIS H 3300 (Vickers hardness 85 after heat expansion) are preferably used. A diameter in the range of 6 to 8 mm and wall thickness in the range of 0.3 to 0.5 mm of the copper tube before expansion is preferable.

The preferable Vickers hardness of the copper tube constituting the heat pipe after heat expansion is in the range of 40 to 90, whereas a tube with a Vickers hardness such as 135, that is beyond the desirable 90, requires excessive time and thus reduces the operating efficiency of vaporizing water as the operating fluid by heating the heat pipe so as to expand the tube, and when used as the fixation roll, the temperature distribution is not likely to be uniform and the heat pipe may disengage during service. Likewise, a tube with a Vickers hardness below 40 may cause damage to the heat pipe during the course of plastic deformation for expansion and may easily deform during service because of the inferior strength of the heat pipe and cause the creation of gaps between the tube and the bore resulting in uneven surface temperature distribution and, in the worst case, the heat pipe may disengage. When the wall thickness of the wall of the copper tube constituting the heat pipe exceeds 0.6 mm, a period of time longer than normal is required to expand the tube under heating, causing difficulties. Likewise, when it is 0.2 mm or thinner, the heat pipe may suffer damage due to the pressure of the heat expansion process. The preferable amount of water as the operating fluid is 7 to 40% of the inner volume of the heat pipe. When it is less than 7%, the pressure of the vapor during heating does not adequately rise and causes insufficient expansion, resulting in inferior fitting tightness of the heat pipe with the inner wall of the cylindrical bore in the core. When the amount of operating fluid exceeds 40%, the wall of the heat pipe is prone to rupture in the event of freezing.

In the thick wall of the fixation roll, a cylindrical bore for the insertion of a heat pipe with a diameter of 6.31 mm was bored, and a heat pipe using a tube consisting of a phosphorous deoxydized copper tube with a diameter of 6.02 mm, wall thickness of 0.4 mm and length of 448 mm and encapsulated water as the operating fluid was inserted in the cylindrical bore, and heated to a temperature of 320° C. (vapor pressure: 114 kgf/cm$^2$). The determined value of the Vickers hardness of the wall of the heat pipe that has been perfectly fitted to the inner wall of the cylindrical bore of the core after 30 minutes of heat expansion operation was 82. On the other hand, the determined value of the Vickers hardness of the wall of the heat pipe that was marginally fitted after 30 minutes of heat expansion was 115.

As the heat pipe to be inserted under the present invention, such as shown in FIG. 3, tube 4 consisting of spiral grooves 6 formed on the inner surface, with encapsulated water as the operating fluid, and with sealed ends by means of TIG welding is applied. As the copper tube constituting tube 4, a tube without inner grooves can be employed, and as the wick 5, not only metal wires, but also metal screens and other known components such as any object that can allow the abovementioned inner grooves to function as a wick can be applied.

The practical manufacture of the fixation roll under the present invention is carried out for example by hot extruding an aluminum alloy such as 3004 and 6063 or any other equivalent into a hollow cylindrical form with specified dimensions and with several bores for the insertion of heat pipes, machining the hot extrudate to the core dimensions, coating the surface of the resultant core with a fluorocarbon resin and subsequently baking at 400° C. for approximately 1 hour to form a covering layer of fluorocarbon resin, inserting a heat pipe into each matching cylindrical bore and subsequently heating the heat pipe to an elevated temperature such as 320° C. for approximately 30 minutes so as to expand the heat pipe to allow the tube to tightly fit onto the inner wall surface of the said cylindrical bore.

Under the present invention, in the fixation roll for electrophotographic apparatus consisting of several heat pipes embedded in the axial direction in the thick wall of a hollow cylindrical core, since several bores are bored in the thick wall of the core in the axial direction, and heat pipes consisting of copper tubes and encapsulated water as the operating fluid are inserted into the bores, and each of the tubes is allowed to be softened by heating so as to facilitate its expansion as well as evaporating the water as the operating fluid so as to force the heat pipe to expand with the pressure and to tightly fit to the inner wall of the cylindrical bore in the core to result an integrated, monolithic structure, sufficient fitting tightness can be achieved, even if the bore diameter does not perfectly match the diameter of the heat pipe, and thus a fixation roll with excellent surface temperature distribution can be obtained.

Since a copper tube with a Vickers hardness in the range of 40 to 90 after heat expansion is employed as the tube for the heat pipe, which is heated to allow the water as the operating fluid to evaporate to generate a pressure to expand the copper tube, the heating conditions can be at a low temperature and in a short period of time and therefore do not give rise to the degradation of the fluorocarbon resin coating layer on the fixation roll. Further, since the pressurization process upon heat expansion of the tube is carried out by means of the operating fluid encapsulated in the tube, there is no need to provide any special means or apparatus and thus the heat expansion operation of the tube can be conducted with extreme simplicity and high efficiency.

The following is the Descriptionof an Example:

EXAMPLE 1

Figure 1:
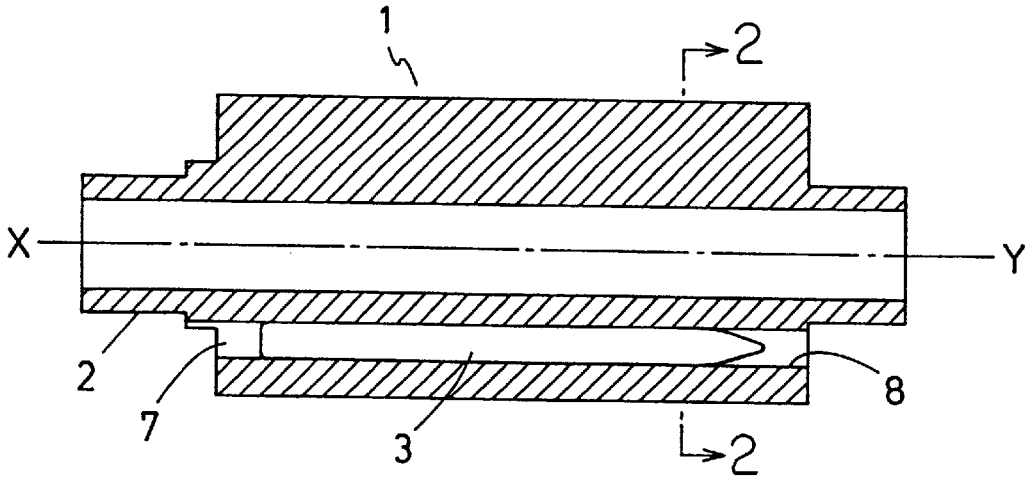
FIG. 1 is a cross-sectional view of the fixation roll of an embodiment of the present invention.
Figure 2:
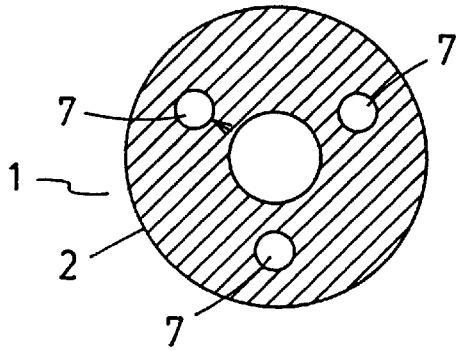
FIG. 2 is a sectional view of Section A—A illustrating a fixation roll from which the heat pipes are removed.

An extruded 6063 aluminum alloy rod was fabricated to form cylindrical bore 7 with a diameter of 6.25 mm at each of three locations equally spaced in the radial direction of a thick wall of a hollow cylinder with a diameter of 60 mm and a wall thickness of 18 mm and with a distance of 8 mm from the inner surface of the hollow cylinder to the center of the bore, as shown in FIGS. 1 and 2.

After coating the surface of the core with a fluorocarbon resin, heat pipes consisting a copper tube of refined 1/16H phosphorous deoxydized copper C1220T conforming to JIS H 3300 (Vickers hardness 85 after heat expansion) with a diameter of 6 mm, wall thickness 0.4 mm and spiral grooves 6 formed on the inner surface as shown in FIG. 3, which is fitted with wick 5, prepared by bending and twisting phosphor bronze wires to form a hairpin shape, and encapsulated water as the operating fluid at a volumetric ratio of 20% of the inner volume of the tube was inserted into the cylindrical bore 7 of the core.

After heating the core to a temperature of 320° C. for 30 minutes, the water as the operating fluid encapsulated in the heat pipe was vaporized to pressurize the heat pipe, which then expanded to fit to the inner wall of the cylindrical bore and thus an integrated, monolithic structure was obtained. It was confirmed that no degradation was observed in the fluorocarbon resin coating layer on the surface of the core after heating at 320° for 30 minutes for the heat expansion of the heat pipe.

The fixation roll thus fabricated and the press roll that had been prepared by coating a stainless steel core of diameter 50 mm with 5 mm thick silicone rubber were installed in the copying machine and halogen heaters, each with an output of 1160 W, were energized so as to maintain the surface temperature of the fixation roll at 200° C. A continuous stream of 100 sheets of A4 copying paper was fed through the copier according to the following procedures. Feed sheet 1, wait 20 seconds, feed sheet 2, wait 20 seconds, etc. to sheet 100, then wait 10 minutes, then take measurements. Repeated tests showed that the temperature difference was less than 1° C., which indicated that there was no practical difference in the temperature between the areas over which the paper passed and the free areas of the surface of the fixation roll.

As described above, the present invention offers a high quality fixation roll with uniformly distributed surface temperatures by incorporating embedded heat pipes, each being tightly fitted to the inner wall surface of a matching cylindrical bore, to form an integrated, monolithic structure. Since the tight fit is effected by the expansion of each heat pipe consisting of copper tube by means of the vapor pressure of water as the operating fluid, the fitting operation can be performed at a moderate temperature and over a short period of time and does not require stringent control of the dimensions of bores in the core for inserting heat pipes and the diameters of each heat pipe.

What is claimed is:

1. A method for producing a fixation roll used in an electrophotographic apparatus, said fixation roll comprising an annular wall having a fluorocarbon coating provided on an exterior surface thereof, a longitudinally extending primary bore and a plurality of secondary bores surrounding said primary bore and having longitudinal axes parallel to the longitudinal axis of the primary bore provided therein and a heat pipe tightly embedded in each secondary bore, said heat pipe comprising a copper tube having water sealed therein, said method comprising the steps of: providing said annular wall; inserting a heat pipe into each secondary bore, said heat pipe having an outer diameter which is smaller than the inner diameter of the secondary bores and heating the heat pipes to convert the water sealed therein to steam and plastically deforming the heat pipes by the vapor pressure of the steam to be tightly fitted in the bores, wherein the improvement comprises said copper tube being an oxygen-free or phosphorus deoxidized copper tube initially having a temper of 0 or 1/16H and a Vickers hardness in the range of 40 to 90 after plastic deformation by the steam.

2. The method of claim 1, wherein said copper tube has inner grooves provided on an inner surface thereof.

3. The manufacturing method of claim 1, wherein the water in the heat pipe is at the ratio of 7 to 40% of the inner volume of the heat pipe.

* * * * *